United States Patent [19]

Correa, III

[11] 4,319,683

[45] Mar. 16, 1982

[54] PORTABLE CONVERTIBLE CASE AND WORK TRAY

[76] Inventor: Joseph F. Correa, III, P.O. Box 755, Kailua, Hi. 96734

[21] Appl. No.: 183,432

[22] Filed: Sep. 2, 1980

[51] Int. Cl.[3] ..... B65D 85/28; B65D 25/28

[52] U.S. Cl. ..... 206/349; 206/372; 220/94 R; 217/8

[58] Field of Search ..... 206/349, 372, 373, 374, 206/375, 45.2, 45.23; 190/1, 17; 217/8; 220/94 R

[56] References Cited

U.S. PATENT DOCUMENTS

| | | | |
|---|---|---|---|
| 513,726 | 1/1894 | Potts | 217/8 |
| 1,699,765 | 1/1929 | Staples | 220/94 A |
| 2,697,460 | 12/1954 | Barnett | 206/349 X |
| 2,804,226 | 8/1957 | Freedman | 217/8 |
| 4,058,210 | 11/1977 | Mitchell | 220/94 R X |

*Primary Examiner*—Steven M. Pollard
*Attorney, Agent, or Firm*—William B. Walter

[57] ABSTRACT

A case for holding and carrying plumbing connections, tools and the like when closed has two opposed hinged doors covering one face of the case, the free edges of which doors meet midway between the opposed hinges. A handle held centrally above the open face of the case when the doors are opened and secured to the box allows the use of the open case as an open work tray. Brackets attached to the inside faces of the doors provide a resting place for a second case thus allowing stacking of the cases for a parts bin to be used at a job site.

4 Claims, 12 Drawing Figures

PORTABLE CONVERTIBLE CASE AND WORK TRAY

BACKGROUND OF THE INVENTION

The usual practice of plumbers, electricians and other skilled trades people in working on installation and modification of equipment and materials is to carry parts and tools in open trays from work vans or trucks into the building or other jobsite, first filling the trays with parts and tools which they anticipate needing on the job from supplies in the van or truck. Such work trays have handles centrally spaced above the trays on fixed arms attaching the handles to the trays. Such trays, being open, are preferably unloaded when returned to the truck or van so that the contents will be sorted and returned to boxes containing like parts and so that the parts will not spill over the floor of the van in transit over rough roads. Also it would be inconvenient to stow a multitude of trays in the truck because of the additional space requirements for the raised handles. Thus the need exists for a more efficient means to carry parts and tools to the jobsite from the truck or van.

BRIEF SUMMARY OF THE INVENTION

The basic object of this invention is to provide a portable parts storage case for craftsmen which when closed will satisfactorily contain the parts in compartments, and when open which will serve as a parts tray with carrying handle centrally located above the open tray.

Another object of this invention is to provide such a portable parts case that a multitude of such cases in open tray condition may be stacked one upon the other to form a parts bin at the job site. Thus each such case can contain a special group of parts and/or tools and placed in the work van, used in the van, and when carried from the van to the job site, opened and carried from point to point in the open tray position, or a multitude of open trays may be stacked one upon the other, the assembly placed on a dolly and, carrying a small bench top, rolled from point to point at the site as a rolling parts bin.

DETAILED DESCRIPTION OF THE INVENTION

Figure 1:
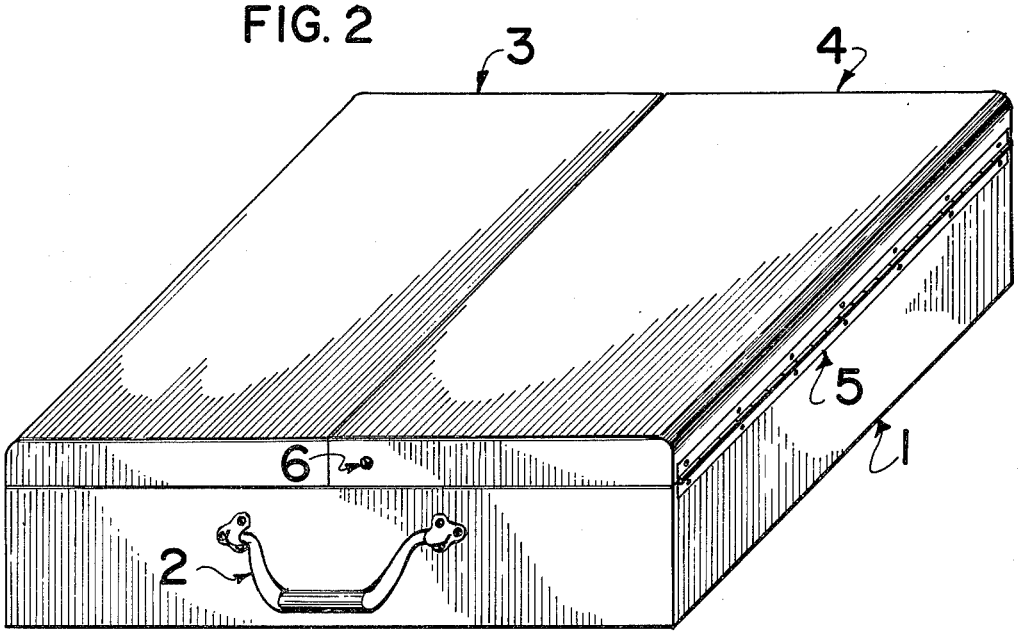
FIG. 1 is a perspective view of a preferred embodiment of the convertible case of my invention as it is lying on its side with the doors closed.

A preferred embodiment of the portable convertible case and work tray of my invention shown closed in FIG. 1 is a box 1 with a hinged suitcase handle 2 centrally located on one end of the box 1 and a pair of doors 3 and 4, each attached to opposite edges of the box 1 by piano hinges 5. These doors 3 and 4 meet at the center of the top of the box 1 as shown. Preferably the doors 3 and 4 are flanged on the hinged edges and along each side. The ends of the mating edges of the flanges on the sides of the doors are cut at an angle such that the flange of one door 4 overlaps that of the other door 3. Thus when the doors 3 and 4 are closed, door 4 holds door 3 closed. A simple push button latch or lock 6 protruding through a mating hole 7 in the overlapping flange with the push button latch attached to the box 1 is used to lock both doors 3 and 4 closed. Such a latch 6 may be used at each side flange of the door 4.

Figure 2:
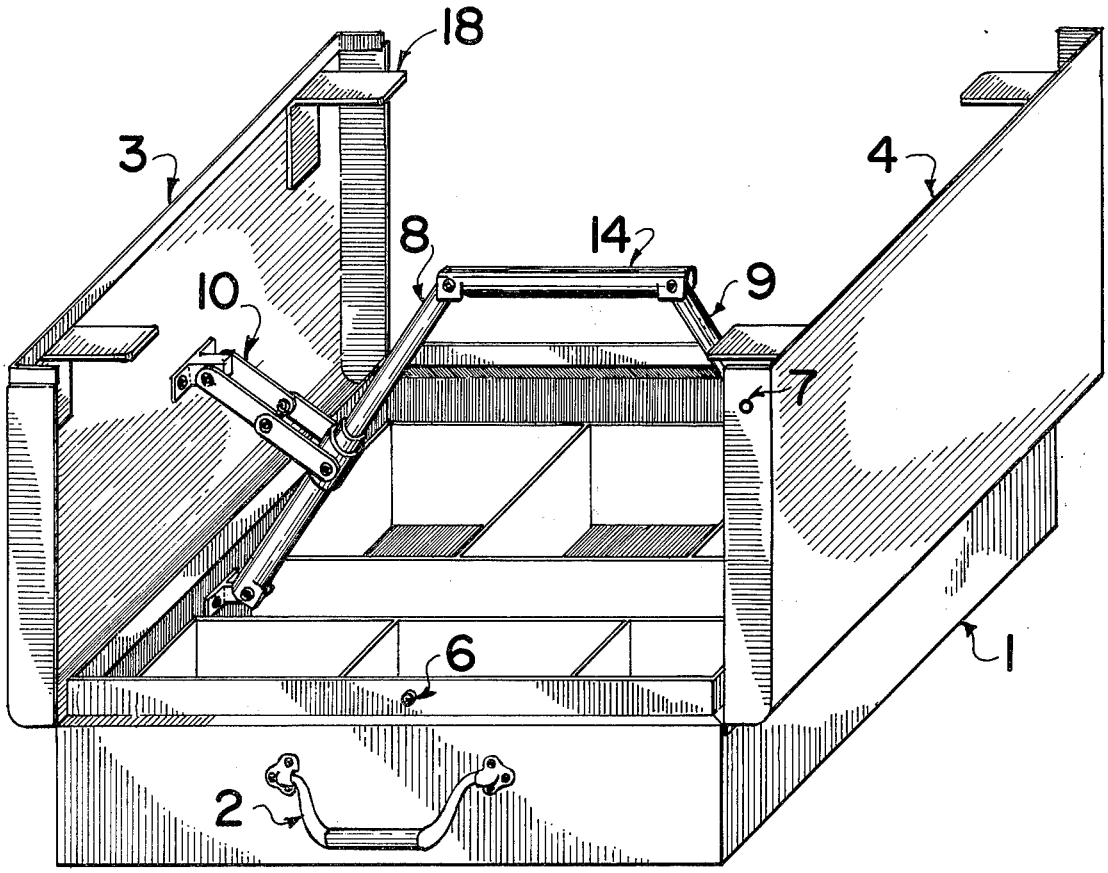
FIG. 2 is a perspective view of the convertible case of FIG. 1 with the doors open and the tray handle extended.

When the doors 3 and 4 are opened as seen in FIG. 2, a pair of telescopic arms 8 and 9 which are pivotably attached to the box 1 centrally of the length of doors 3 and 4 are pulled up out of the box 1 by folding arms 10 and 11. The doors 3 and 4 are first opened sufficiently to unfold arms 10 and 11 and then a tray handle 14 pivotably connecting the telescopic arms 8 and 9 is pulled up out of its central stowed position in the box 1 to extend the telescopic arms 8 and 9 until the doors 3 and 4 are swung into an upright position. The tray handle 14 is then in position to be used to carry the case 1 as an open work tray.

Figure 3:
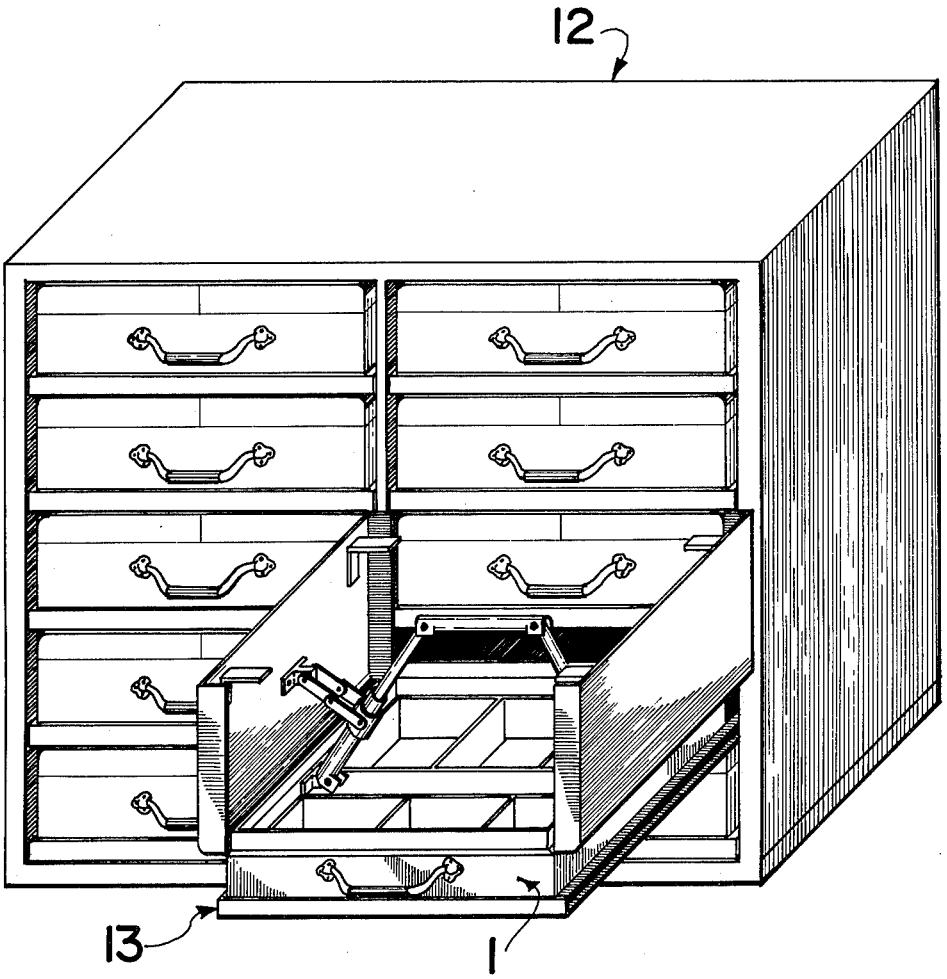
FIG. 3 is a perspective view of a multitude of the convertible cases of FIGS. 1 and 2 as stored in a cabinet having sliding drawer frames, with one of the convertible cases pulled out on its sliding drawer frame, and the doors of this case open.

A number of convertible cases 1 may be carried in a workshop van in a cabinet 12 having a series of drawer slide frames 13 to receive the convertible cases 1 as shown in FIG. 3. Each case 1 may be labeled and carry a separate assortment of parts and/or tools. Cases 1 may be individually pulled out on their drawer slide frames 13 and opened for access to the parts and tools in the van, removed closed and carried to the job site.

Figure 4:
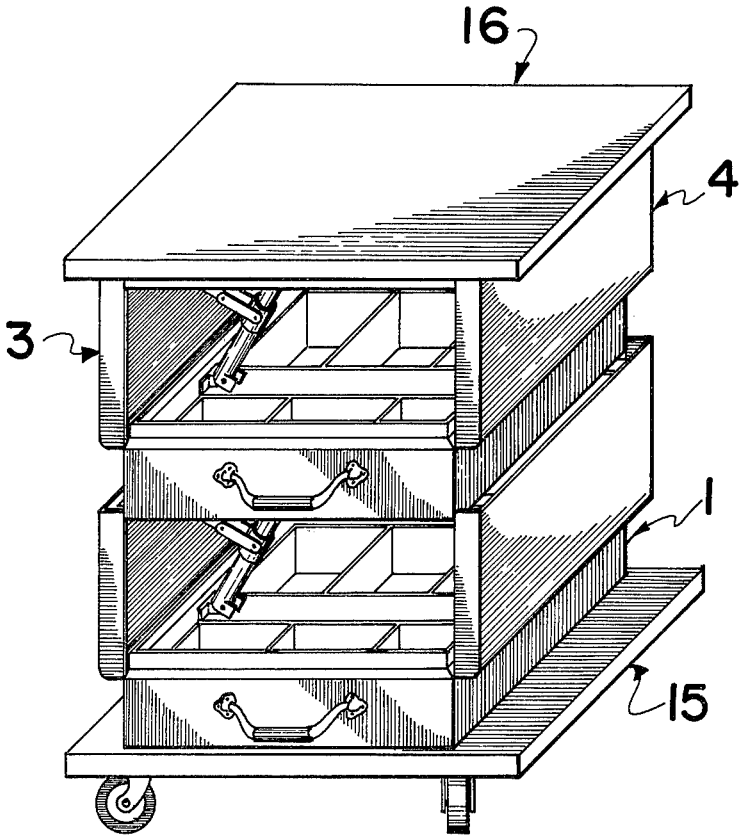
FIG. 4 is a perspective view of two of the convertible cases of FIGS. 1–3 with the doors open and stacked upon one another with the lowermost open case nested in a dolly frame and a bench top fitted into the open doors of the uppermost case.

When carried to the job site, the cases 1 may be opened to serve as parts trays and stacked one upon the other as in FIG. 4, the bottom tray 14 being nested in a dolly frame 15 to allow the assembly of open work trays to be readily moved from place to place as the work progresses with the parts and tools in each case being readily accessible. A work bench top 16 may be nested into the open door of the top tray 17. Support brackets 18 attached to the inside doors 3 and 4 of each case 1 are used as a rest for the tray or bench top 16 placed on top of the brackets 18 between the open doors 3 and 4 of the case 1 below thus utilizing the pair of rigid doors as a support.

Figure 5:
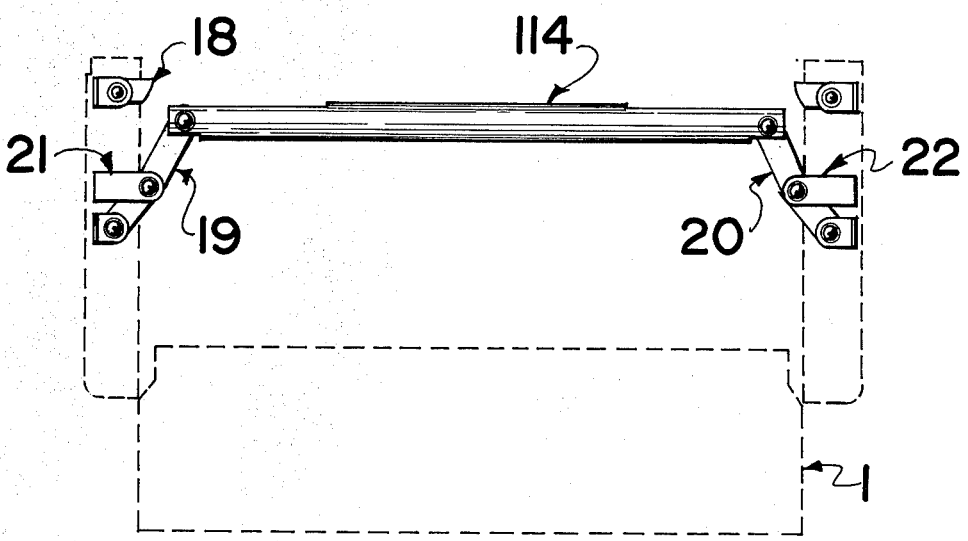
FIG. 5 is an end elevation of another version of convertible case according to my invention with the doors open.

In a second version of the convertible case 1 according to my invention as shown in FIG. 5, the tray handle 114 is attached to the doors 3 and 4 by pivoted links 19 and 20. When the doors 3 and 4 are open and upright as shown in FIG. 5, pivoted stop arms 21 and 22 lock the links 19 and 20 and the handle 114 to the doors 3 and 4 in the position shown. When the stop arms 21 and 22 are swung out of the way alongside links 19 and 20 the handle 114 will drop down into the box 1 carrying the doors 3 and 4 into a closed position as shown in FIG. 6.

Figure 6:
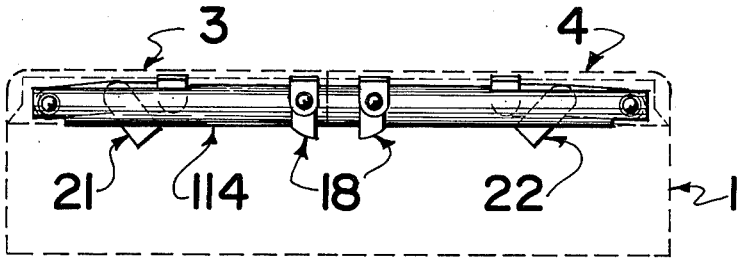
FIG. 6 is a cutaway end elevation of the case of FIG. 5 with the doors closed and the tray handle stowed in the closed case.
Figure 7:
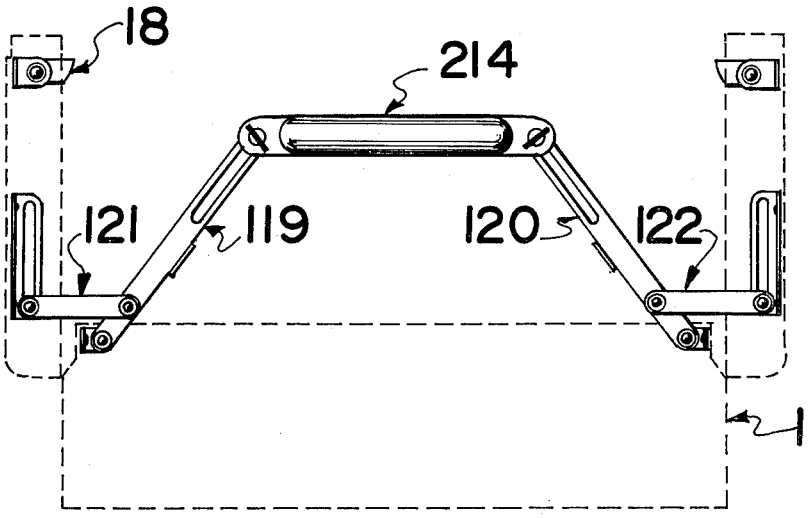
FIG. 7 is an end elevation of another version of the case of my invention with the doors open.

A variation of the version of FIGS. 5 and 6 is that shown in FIG. 7 in which pivoted links 119 and 120 are slotted to allow the handle 214 to be stowed in the box 1 when the doors 3 and 4 are closed and the stop arms 121 and 122 are connected to doors 3 and 4 by slotted brackets 23 and 24 which are attached to the doors 3 and 4 by rivets or welds.

Figure 8:
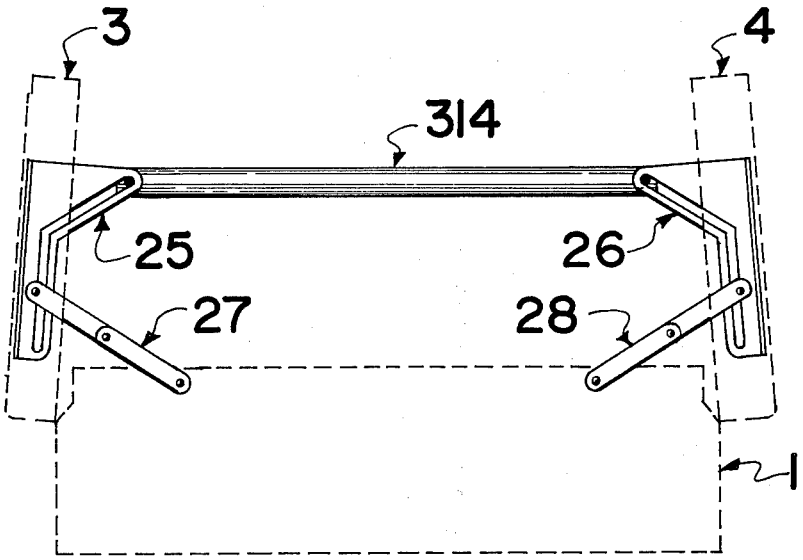
FIG. 8 is an end elevation of still another version of the case of my invention with the doors open.
Figure 9:
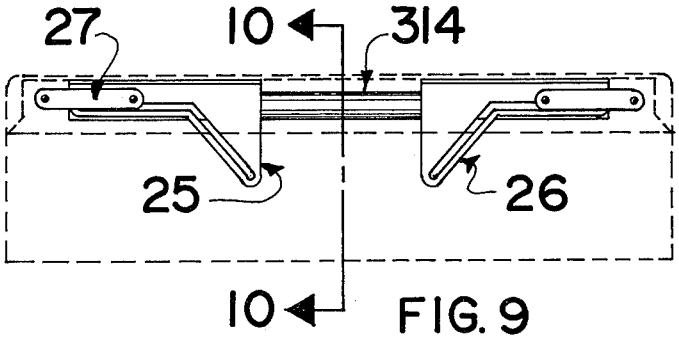
FIG. 9 is a cutaway end elevation of the case of FIG. 8 with the doors closed and the tray handle stowed within the case.
Figure 10:
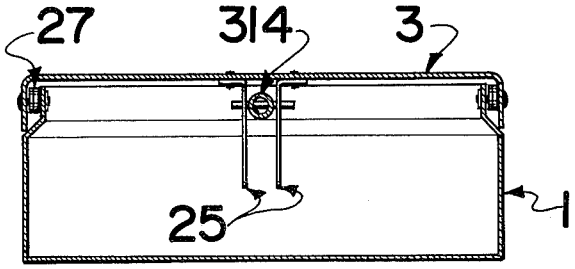
FIG. 10 is a sectional view on the line 10—10 of FIG. 9.

In another version of my invention as shown in FIGS. 8–10, the pinned ends of handle 314 slide in slotted brackets 25 and 26 from a position above the open tray in FIG. 10 to a stowed position in the box 1 as shown in FIGS. 9 and 10. Folding arms 27 and 28 are used to lock the doors 3 and 4 in the open position and may be folded to close the doors 3 and 4.

Figure 11:
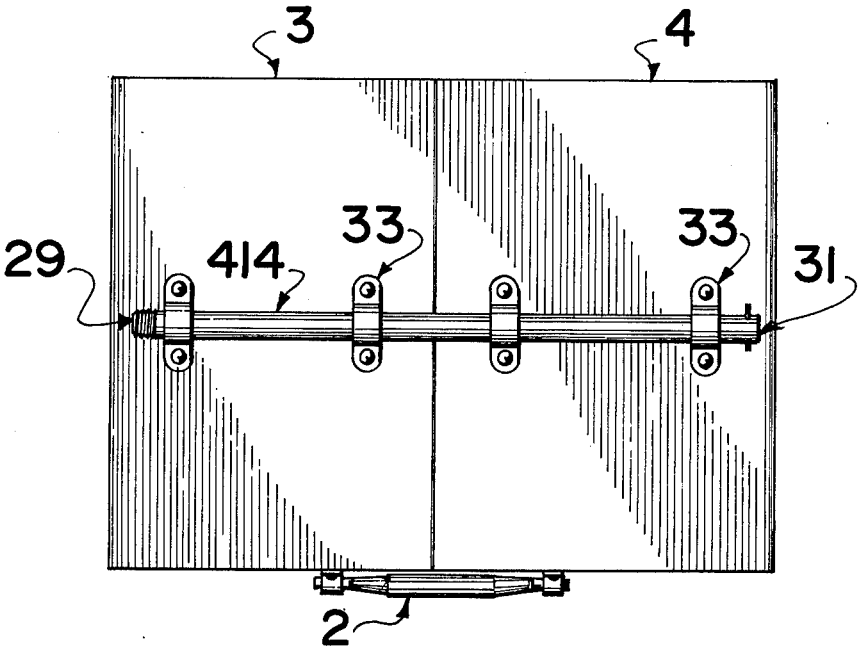
FIG. 11 is a plan view of another version of the convertible case of my invention.
Figure 12:
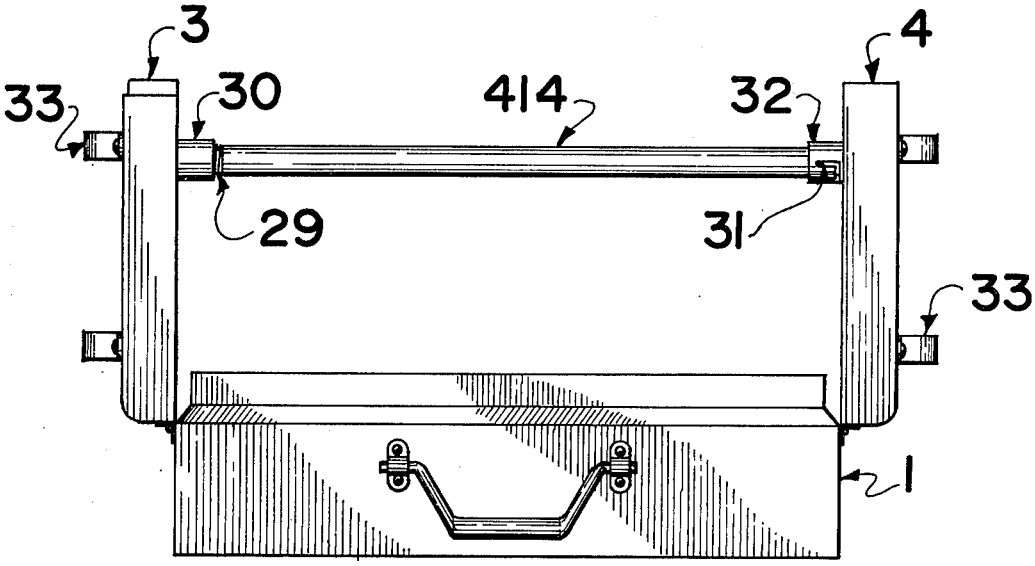
FIG. 12 is an end elevation of the case of FIG. 11 with the doors open and the tray handle installed.

In another version of the convertible case of my invention, the handle 414 is a pipe, threaded on one end 29 to be secured to the left hand door 3 when open in the threaded pipe flange 30 attached to door 3. The other end 31 of the handle 514 can be slipped into the bayonet socket flange 32 attached to the right hand door 4. When the doors 3 and 4 are to be closed, the handle 514 is removed from the flanges 30 and 32 and slipped into pipe brackets 33 on the outside of the doors 3 and 4 for stowage and to hold the doors 3 and 4 closed as seen in FIG. 11.

I claim:

1. A portable convertible case and work tray comprising:

a. an open topped box;

b. a first hinge means, one leg of which is operatively attached to and along one open edge of said box;

c. a second hinge means, one leg of which is attached to the open edge of said box opposite that edge of said box to which the first hinge means is attached;

d. a first substantially rigid door operatively attached along one edge to the leg of said first hinge means which is not attached to the box, said first door being of such length and width as to substantially cover the half of the open face of said box adjacent to said first hinge means;

e. a second substantially rigid door operatively attached along one edge to the leg of said second hinge means which is not attached to the box, said second door being of such length and width as to substantially cover the half of the open face of said box adjacent to said second hinge means;

f. a first handle operatively attached to the box on the outside face of one sidewall of the box;

g. a second handle;

h. a first arm pivotably attached at one end of the arm to the open edge of the box to which the first hinge means is attached and the other end being operatively attached to said handle;

i. a second arm pivotably attached at one end of the second arm to the open edge of the box to which the second hinge means is attached and the other end being operatively attached to said handle so as to place the handle centrally over the open box when the doors are open; whereby when the doors are open the case becomes a work tray carried by the second handle and when the doors are closed, the case may be carried by the first handle.

2. A portable convertible case as claimed in claim 1 wherein said first and second arms are operatively connected to said first and second doors whereby as the doors are opened, the second handle is moved into tray carrying position, and as the doors are closed, the second handle is moved into a stowed position within said case.

3. A portable convertible case as claimed in claim 1 wherein said first and second doors serve as the first and second arms and the second handle is selectively attached to the doors when open or removed therefrom to allow the doors to be closed and comprising stowage means for the second handle across the closed doors so as to hold the doors closed.

4. A portable convertible case as claimed in claim 1 also comprising supporting means operatively attached to the inside surface of each of the doors whereby a second case may be placed on and across the doors when the doors are open thus allowing stacking of a multitude of said cases maintaining access to the interior of each case.

* * * * *